US007955249B2

(12) United States Patent
Perkins et al.

(10) Patent No.: US 7,955,249 B2
(45) Date of Patent: Jun. 7, 2011

(54) OUTPUT TRANSDUCERS FOR HEARING SYSTEMS

(75) Inventors: Rodney Perkins, Woodside, CA (US); Sunil Puria, Sunnyvale, CA (US); Jonathan Fay, San Mateo, CA (US); John H. Winstead, Sunnyvale, CA (US)

(73) Assignee: EarLens Corporation, Redwood City, CA (US)

( * ) Notice: Subject to any disclaimer, the term of this patent is extended or adjusted under 35 U.S.C. 154(b) by 1242 days.

(21) Appl. No.: 11/264,594

(22) Filed: Oct. 31, 2005

(65) Prior Publication Data

US 2007/0100197 A1 May 3, 2007

(51) Int. Cl.
*H04R 25/00* (2006.01)

(52) U.S. Cl. ..... 600/25

(58) Field of Classification Search ..... 600/25; 381/312, 328; 623/10

See application file for complete search history.

(56) References Cited

U.S. PATENT DOCUMENTS 4,002,897 A * 1/1977 Kleinman et al.
4,075,042 A 2/1978 Das
4,252,440 A * 2/1981 Frosch et al.
4,334,321 A * 6/1982 Edelman
4,524,294 A * 6/1985 Brody
4,641,377 A * 2/1987 Rush et al.
4,766,607 A * 8/1988 Feldman
5,015,225 A * 5/1991 Hough et al.
5,031,219 A 7/1991 Ward et al.
5,167,235 A * 12/1992 Seacord et al.
5,259,032 A * 11/1993 Perkins et al.
5,276,910 A * 1/1994 Buchele
5,425,104 A * 6/1995 Shennib
5,456,654 A * 10/1995 Ball
5,531,787 A 7/1996 Lesinski et al.
5,554,096 A * 9/1996 Ball
5,772,575 A * 6/1998 Lesinski et al.
5,774,259 A * 6/1998 Saitoh et al.
5,797,834 A * 8/1998 Goode
5,804,109 A * 9/1998 Perkins
6,084,975 A * 7/2000 Perkins et al.
6,137,889 A * 10/2000 Shennib et al.
6,277,148 B1 * 8/2001 Dormer
6,312,959 B1 * 11/2001 Datskos
6,339,648 B1 * 1/2002 McIntosh et al.
6,354,990 B1 * 3/2002 Juneau et al.
6,366,863 B1 * 4/2002 Bye et al.
6,385,363 B1 * 5/2002 Rajic et al.
6,387,039 B1 * 5/2002 Moses
6,393,130 B1 * 5/2002 Stonikas et al.
6,432,248 B1 * 8/2002 Popp et al.
6,436,028 B1 * 8/2002 Dormer (Continued)

OTHER PUBLICATIONS

Athanassiou et al; "Laser controlled photomechanical actuation of photochromic polymers Microsystems" *Rev. Adv. Mater. Sci.*, 5 (2003), pp. 245-251.

(Continued)

*Primary Examiner* — Charles A Marmor, II
*Assistant Examiner* — Christine D Hopkins
(74) *Attorney, Agent, or Firm* — Kilpatrick Townsend & Stockton LLP

(57) ABSTRACT

Apparatus for directly stimulating a tympanic membrane or other acoustic member comprising a support with a plurality of activatable elements. The support can be mounted on the tympanic membrane and the activatable elements are distributed on the support to provide a distributed vibration to the tympanic membrane.

60 Claims, 10 Drawing Sheets

U.S. PATENT DOCUMENTS

| | | | | |
|---|---|---|---|---|
| 6,438,244 | B1 * | 8/2002 | Juneau et al. | |
| 6,473,512 | B1 * | 10/2002 | Juneau et al. | |
| 6,475,134 | B1 * | 11/2002 | Ball et al. | |
| 6,493,454 | B1 * | 12/2002 | Loi et al. | |
| 6,592,513 | B1 * | 7/2003 | Kroll et al. | |
| 6,603,860 | B1 * | 8/2003 | Taezner et al. | |
| 6,629,922 | B1 | 10/2003 | Puria et al. | |
| 6,676,592 | B2 | 1/2004 | Ball et al. | |
| 6,695,943 | B2 | 2/2004 | Juneau et al. | |
| 2001/0027342 | A1 | 10/2001 | Dormer | |
| 2002/0183587 | A1 | 12/2002 | Dormer | |
| 2004/0240691 | A1 | 12/2004 | Grafenberg | |
| 2005/0036639 | A1 | 2/2005 | Bachler et al. | |
| 2006/0189841 | A1 * | 8/2006 | Pluvinage | 600/25 |

OTHER PUBLICATIONS

Baer et al., "Effects of Low Pass Filtering on the Intelligibility of Speech in Noise for People With and Without Dead Regions at High Frequencies," *J. Acost. Soc. Am* 112 (3), pt. 1, (Sep. 2002), pp. 1133-1144.

Best et al., "Influence of High Frequencies on Speech Locatisation," Abstract 981, Feb. 24, 2003, retrieved from: http://www.aro.org/abstracts.html.

Burkhard et al., "Anthropometric Manikin for Acoustic Research," *J. Acoust. Soc. Am*., vol. 58, No. 1, (Jul. 1975), pp. 214-222.

Camacho-Lopez et al., "Fast Liquid Crystal Elastomer Swims Into the Dark," Electronic Liquid Crystal Communications, (Nov. 26, 2003), 9 pages total.

Carlile et al., "Spatisation of Talkers and Segregation of Concurrent Speech," Abstract 1264, Feb. 24, 2004, retrieved from: http://www.aro.org/abstracts.html.

Datskos et al., "Photoinduced and thermal stress in silicon microcantilevers", Applied Physics Letters vol. 73, No. 16 (Oct. 19, 1998), pp. 2319-2321.

Decraemer et al., "A Method For Determining Three-Dimensional Vibration In The Ear," *Hearing Research*, 77 (1-2): 19-37 (1994).

Fay et al., "Cat Eardrum Response Mechanics," Mechanics and Computation Division, Department of Mechanical Engineering, Stanford University, (2002), 10 pages total.

Fletcher, "Effects of Distortion on the Individual Speech Sounds", Chapter 18, *ASA Edition of Speech and Hearing in Communication*, Acoust Soc.of Am. (republished in 1995) pp. 415-423.

Freyman et al., "Spatial Release from Informational Masking in Speech Recognition," *J. Acost. Soc. Am*., vol. 109, No. 5, pt. 1, (May 2001), pp. 2112-2122.

Freyman et al., "The Role of Perceived Spatial Separation in the Unmasking of Speech," *J. Acoust. Soc. Am*., vol. 106, No. 6, (Dec. 1999) pp. 3578-3588.

Gobin et al; "Comments on the physical basis of the active materials concept" *Proc. SPIE* 4512, pp. 84-92.

Hato et al., "Three-Dimensional Stapes Footplate Motion in Human Temporal Bones." *Audiol Neurootol* , 8: 140-152, (2003).

Hofman et al., "Relearning Sound Localization With New Ears," *Nature Neuroscience*, vol. 1, No. 5, (Sep. 1998), pp. 417-421.

Jin et al., "Speech Localization", J. Audio Eng. Soc. convention paper, presented at the *AES* 112th Convention, Munich, Germany, May 10-13, 2002, 13 pages total.

Killion, "Myths About Hearing Noise and Directional Microphones," *The Hearing Review*, vol. 11, No. 2, (Feb. 2004), pp. 14, 16, 18, 19, 72 & 73.

Lezal, "Chalcogenide glasses—survey and progress", Journal of Optoelectronics and Advanced Materials vol. 5, No. 1, (Mar. 2003), pp. 23-34.

Martin et al. "Utility of Monaural Spectral Cues is Enhanced in the Presence of Cues to Sound-Source Lateral Angle," *JARO*, vol. 5, (2004), pp. 80-89.

Moore, "Loudness Perception and Intensity Resolution", *Cochlear Hearing Loss*, Whurr Publishers Ltd., (1998), Chapter 4, pp. 90-115.

Musicant et al., "Direction-Dependent Spectral Properties of Cat External Ear: New Data and Cross-Species Comparisons," *J. Acostic. Soc. Am*, May 10-13, 2002, vol. 87, No. 2, (Feb. 1990), pp. 757-781.

Poosanaas et al., "Influence of sample thickness on the performance of photostrictive ceramics," *J. App. Phys*., vol. 84, No. 3, (Aug. 1, 1998), pp. 1508-1512.

Puria and Allen, "Measurement and Model of the Cat Middle Ear: Evidence of Tympanic Membrane Acoustic Delay," *Journal of the Acoustical Society of America*, 104 (6): 3463-3481 (1998).

Puria et al., "Sound-Pressure Measurements In The Cochlear Vestibule Of Human-Cadaver Ears," *Journal of the Acoustical Society of America*, 101 (5-1): 2754-2770, (1997).

Sekaric et al., "Nanomechanical resonant structures as tunable passive modulators," *App. Phys. Lett*., vol. 80, No. 19, (Nov. 2003), pp. 3617-3619.

Shaw, "Transformation of Sound Pressure Level From the Free Field to the Eardrum in the Horizontal Plane," *J. Acoust. Soc. Am*., vol. 56, No. 6, (Dec. 1974), 1848-1861.

Shih, "Shape and displacement control of beams with various boundary conditions via photostrictive optical actuators," *Proc. IMECE* (Nov. 2003), pp. 1-10.

Stuchlik et al, "Micro-Nano actuators driven by polarized light", *IEE Proc. Sci. Meas. Techn*. Mar. 2004, vol. 151, No. 2, (Mar. 2004), pp. 131-136.

Suski et al., "Optically activated ZnO/SiO2/Si cantilever beams", *Sensors and Actuators A* (Physical), 0 (nr: 24), pp. 221-225.

Takagi et al.; "Mechanochemical Synthesis of Piezoelectric PLZT Powder", *KONA*, vol. 151, No. 21, (2003), pp. 234-241.

Thakoor et al., "Optical microactuation in piezoceramics", *Proc. SPIE* (Jul. 1998) vol. 3328, pp. 376-391.

Tzou et al; "Smart Materials, Precision Sensors/Actuators, Smart Structures, and Structronic Systems", *Mechanics of Advanced Materials and Structures*, vol. 11, (2004), pp. 367-393.

Uchino et al.; "Photostricitve actuators," *Ferroelectrics* (2001), vol. 258, pp. 147-158.

Vickers et al., "Effects of Low-Pass Filtering on the Intelligibility of Speech in Quiet for People With and Without Dead Regions at High Frequencies," *J. Acoust. Soc. Am*., vol. 110, No. 2, (Aug. 2001), pp. 1164-1175.

Wiener et al., "On the Sound Pressure Transformation By the Head and Auditory Meatus of the Cat", *Acta Otolaryngol*., vol. 61, No. 3, (Mar. 1966), pp. 255-269.

Wightman et al., "Monaural Sound Localization Revisited," *J. Acoust. Soc. Am*., vol. 101, No. 2, (Feb. 1997), pp. 1050-1063.

Yu et al. "Photomechanics: Directed bending of a polymer film by light", *Nature*, vol. 425, (Sep. 2003), p. 145.

* cited by examiner

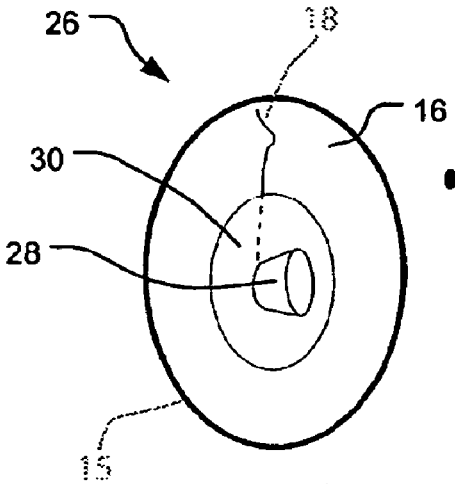
FIG. 3A
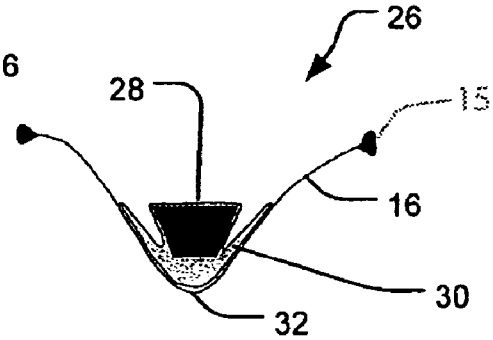
FIG. 3B
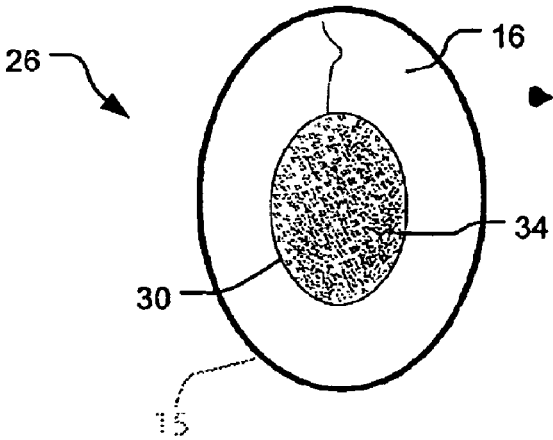
FIG. 4A
FIG. 4B
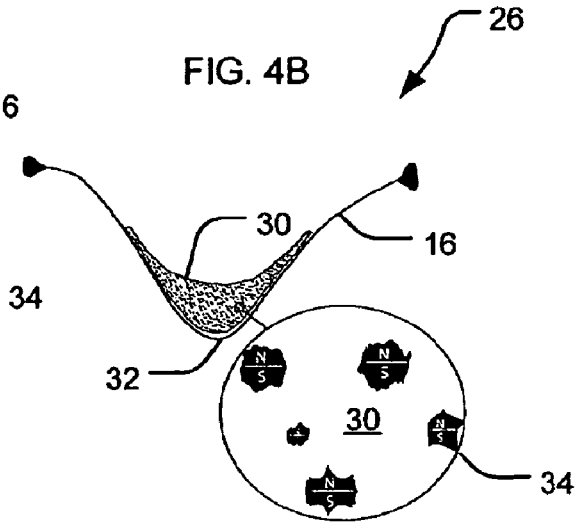
FIG. 4C

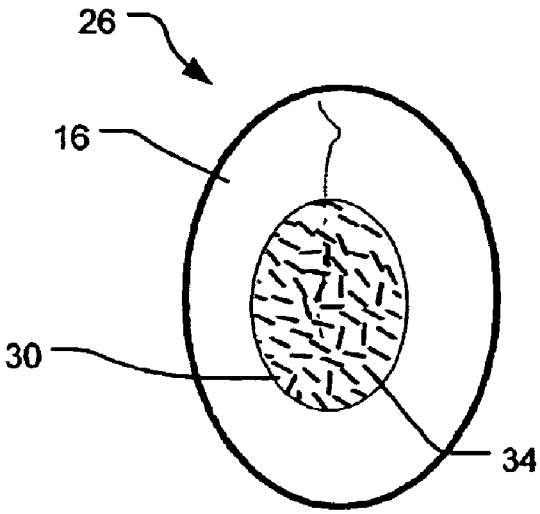
FIG. 5A
FIG. 5B
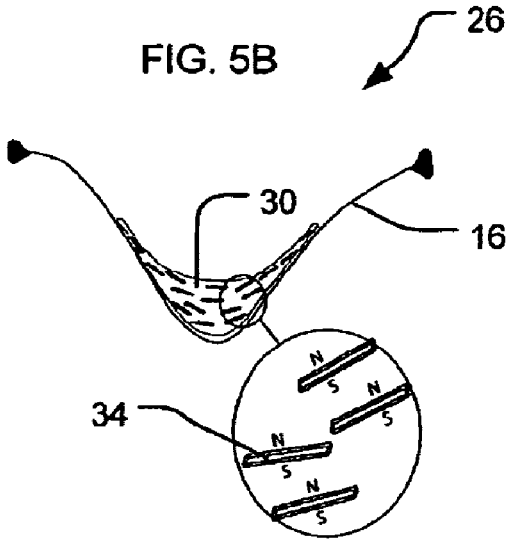
FIG. 5C
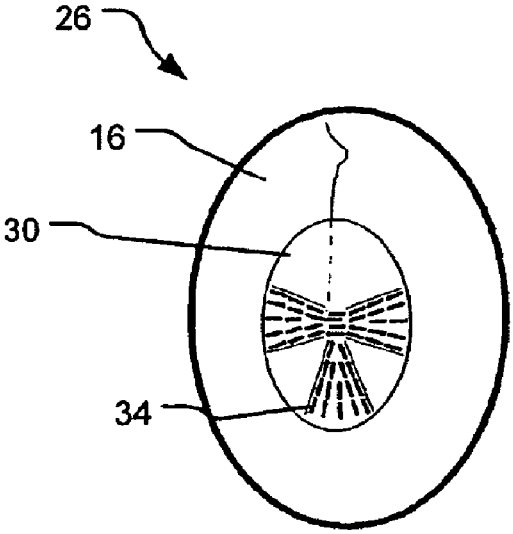
FIG. 6A
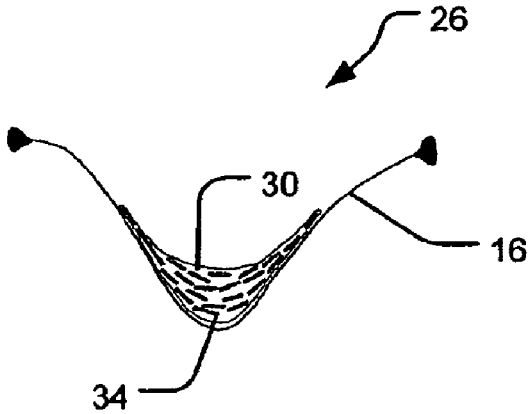
FIG. 6B

OUTPUT TRANSDUCERS FOR HEARING SYSTEMS

CROSS-REFERENCES TO RELATED APPLICATIONS

The present application is related to commonly owned U.S. patent application Ser. No. 10/902,660, filed Jul. 28, 2004, entitled "Transducer for Electromagnetic Hearing Devices"Ser. No. 11/121,517, filed May 3, 2005, entitled "Hearing System Having Improved High Frequency Response," and Ser No. 11/248,459, filed on Oct. 11, 2005, entitled "Systems and Methods for Photo-Mechanical Hearing Transduction," the complete disclosures of which are incorporated herein by reference. The present application is also related to commonly owned U.S. Pat. Nos. 6,084,975, 5,804,109, 5,425,104, 5,276,910 and 5,259,032 the complete disclosures of which are also incorporated herein by reference.

BACKGROUND OF THE INVENTION

The present invention relates generally to hearing systems, output transducers, methods, and kits. More particularly, the present invention is directed to hearing systems that comprise a plurality of activatable elements that are distributed on a support component to produce vibrations, that correspond to the ambient sound signals, on a portion of the human ear. The systems may be used to enhance the hearing process of those that have normal or impaired hearing.

Many attempts have been made to magnetically drive the eardrum and/or middle ear ossicles. To date, three types of approaches have been used. The first approach was to attach a permanent magnet, or a plurality of magnets, to one of the ossicles of the middle ear. A second approach was to attach super-paramagnetic particles to the outer surface of the ossicles using a collagen binder. The third approached suspended permanent magnets on the eardrum with a flexible support that clings to the eardrum through the use of a fluid and surface tension. The last approach is referred to herein as the "ear lens system," and is described in commonly owned U.S. Pat. Nos. 5,259,032, 6,084,975 both to Perkins et al., the complete disclosures of which were previously incorporated herein by reference.

As shown in FIGS. 3A and 3B, in the conventional ear lens system, an output transducer assembly 26 comprises a magnetic frustum 28 that is embedded on a support component 14 that floats on a surface of the tympanic membrane 16. An input transducer (not shown) delivers a signal to the output transducer assembly 26 to cause a vibration in the tympanic membrane 16 that corresponds to the ambient sound received by the input transducer assembly.

While the ear lens system has been successful, the ear lens system can still be improved. For example, an alignment of the magnetic axis of the magnet with the applied magnetic field lines is important for the proper operation of the ear lens system. If the magnet is not properly aligned with the external field lines, it will not vibrate in a way that leads to the best transmission of sound into the ear. Thus, if the magnet is not properly aligned, the magnet may simply rotate rather than experience translational motion. Unfortunately, the alignment problem is made very difficult by the tortuous and irregularly shaped human ear canal anatomy. In addition, it varies greatly from person to person. Therefore, if one attempts to generate a magnetic field using a device located in the ear canal, it is often very difficult to align the generated magnetic field with the magnetic axis of the permanent magnet on the ear lens system. Moreover, the current needed to generate a magnetic field to drive the ear lens with both sufficient force to enable hearing assistance and still have the battery last a reasonable amount of time for a product is on the boundary of current battery technology capabilities. This leads to the need to precisely control the spacing of the transmitter generating the driving magnetic field and the ear lens magnet.

The inefficiency of magnets floating on the tympanic membrane was reported in seven subjects, by Perkins (1996). The average maximum gain of 25 dB was at 2 kHz. However, above 2 kHz the gain decreased and was more variable. The reduced gain at high frequencies is a primary cause for abandoning the previous approach.

Furthermore, it has been known that that the tympanic membrane has multiple modes of vibrations above 1-2 kHz (Tonndorf and Khanna 1970). It is now known that this results in motions of the umbo, at the center of the tympanic membrane, in the three dimensions of space (Decraemer et al. 1994). These modes of vibrations were not initially considered in the design of the electromagnetic systems described by Perkins et al. Part of the reason for the inefficiency has to do with rotational motion of the magnet (instead of translational movement) which is inefficiently coupled to the tympanic membrane.

Measurements by Decraemer et al. (1989) and subsequent model calculations (Fay 2001; Fay et al. 2002) suggest that at frequencies above 1-2 kHz, the motion of the tympanic membrane is significantly higher, by up to 20 dB, at the outer edge than at the center of the tympanic membrane. This suggests that an outer portion of the tympanic membrane can be actuated more efficiently. Several experiments showed that indeed a small magnet attached near the peripheral edge moved quite a bit. However, this motion is reduced by as much as 20 dB at the umbo and is thus not well coupled to the center of the drum due the higher impedance there. In addition, the umbo motion is smoothly varying and does not have the wild amplitude fluctuations present at the outer edge of the eardrum.

Consequently, what are needed are hearing systems, output transducers and methods that can actuate the center of the tympanic membrane and a periphery of the tympanic membrane differently, so as to better reflect the natural movement of the tympanic membrane.

DESCRIPTION OF THE BACKGROUND ART

U.S. Pat. Nos. 5,259,032 and 5,425,104 have been described above. Other patents of interest include: U.S. Pat. Nos. 5,015,225; 5,276,910; 5,456,654; 5,797,834; 6,084,975; 6,137,889; 6,277,148; 6,339,648; 6,354,990; 6,366,863; 6,387,039; 6,432,248; 6,436,028; 6,438,244; 6,473,512; 6,475,134; 6,592,513; 6,603,860; 6,629,922; 6,676,592; and 6,695,943. Other publications of interest include: U.S. Patent Publication Nos. 2002-0183587, 2001-0027342; Journal publications Decraemer et al., "A method for determining three-dimensional vibration in the ear," *Hearing Res.,* 77:19-37 (1994); Puria et al., "Sound-pressure measurements in the cochlear vestibule of human cadaver ears," *J. Acoust. Soc. Am.,* 101(5):2754-2770 (May 1997); Moore, "Loudness perception and intensity resolution," *Cochlear Hearing Loss*, Chapter 4, pp. 90-115, Whurr Publishers Ltd., London (1998); Puria and Allen "Measurements and model of the cat middle ear: Evidence of tympanic membrane acoustic delay," *J. Acoust. Soc. Am.,* 104(6):3463-3481 (December 1998); Hoffman et al. (1998); Fay et al., "Cat eardrum response mechanics," Calladine Festschrift (2002), Ed. S. Pellegrino, The Netherlands, Kluwer Academic Publishers; and Hato et al., "Three-dimensional stapes footplate motion in human temporal bones," *Audiol. Neurootol.,* 8:140-152 (Jan. 30, 2003). Conference presentation abstracts: Best et al., "The influence of high frequencies on speech localization," Abstract 981 (Feb. 24, 2003) from <www.aro.org/abstracts/abstracts.html>, and Carlile et al., "Spatialisation of talkers and the segregation of concurrent speech," Abstract 1264 (Feb. 24, 2004) from <www.aro.org/abstracts/abstracts.html>.

BRIEF SUMMARY OF THE INVENTION

The present invention provides hearing systems, output transducer assemblies and methods that improve actuation of an acoustic member of a subject. The output assemblies and hearing systems of the present invention may comprise a plurality of distributed, activatable elements so as to provide improved actuation of an acoustic member of a subject, and hence improved hearing.

The hearing systems and output transducers of the present invention are attached to an acoustic member of the middle or inner ear of the subject, and typically coupled to a tympanic membrane of the subject. It should be appreciated however, that the output transducers of the present invention may be removably or permanently attached to other acoustic members in the middle or inner ear. For example, the output transducer may be coupled to ossicular chain, cochlea, or the like. Thus, while the remaining discussion focuses on coupling of the output transducer to the tympanic membrane, the concepts of the present invention may be relevant to actuation other portions of the subject's inner or middle ear.

The hearing systems and output transducer assemblies typically include a support component that is configured to be coupled to an acoustic member of a subject and a plurality of activatable elements that are distributed over the support component. The activatable elements are configured to receive a signal from an input transducer and provide a distributed vibration across the acoustic member in accordance with the signal from the input transducer.

Multiple activatable elements (e.g., magnets), with a distributed weight equal to the weight of a single combined (lumped) element at the center, such that the weight of each element is inversely proportional to the number of elements, could be attached around the tympanic membrane annulus to obtain the same displacement as the single lumped element at the center of the tympanic membrane. In such embodiments, the activatable elements are distributed around the peripheral edge of the tympanic membrane and will be better able to vibrate the tympanic membrane particularly at high frequencies. However, when three or four small magnets are attached to the tympanic membrane there can be interaction between the magnets, with the net result being, that the magnets can detach, flip and bunch up together. To overcome this problem, the multiple magnets are preferably sized and spaced from each other so as to not interact with each other for a given platform material. Second, it is desirable to limit the actuation of a center portion of the tympanic membrane along a translation direction so that there is little transmission loss on the eardrum.

By distributing the activatable particles over a surface of a support component that is in contact with the tympanic membrane, a much larger activatable surface is generated. By intersecting more field lines, the distributed approach should be able to provide a much larger driving force to the tympanic membrane for the same amount of input current that is used in conventional lumped magnet output transducer assemblies. Thus, if the same amount of force is needed, it would be possible to reduce the amount of current while still providing the same amount of driving force. This in turn, will relax the placement tolerances of the transmitter relative to the output transducer assembly and may extend the battery life of the hearing system.

The plurality of activatable elements may be comprised of a variety of different types of elements. The type of activatable element will depend on the makeup of the rest of the hearing system. For example, if the input transducer assembly that receives the ambient sound produces an electromagnetic signal, the output transducer will comprise a plurality of electromagnetic elements. Likewise, if the input transducer produces an optical signal, the output transducer will comprise a plurality of photosensitive materials. Other suitable input transducer assembly include, but are not limited to, ultrasound, infrared, and radio frequencies. Consequently, a variety of different activatable materials, or the like, may be used for the activatable elements of the output transducer, depending on the type of input transducer assembly used in the hearing system.

One preferred embodiment of the activatable elements is an electromagnetic element, such as a magnetized ferromagnetic material (e.g., iron, nickel, cobalt, or the like). The magnetic material activatable elements are subjected to displacement by an electromagnetic field to impart vibrational motion to the portion of the acoustic member, to which it is attached, thus producing sound perception by the wearer of such an electromagnetically driven system.

In some embodiments, the output transducer assembly and hearing systems encompassed by the present invention may optionally have different sized, shaped elements, or different concentrations in a coating of the same activatable elements that are tuned in frequency to their respective quadrants of the tympanic membrane so as to provide direct drive actuation of the middle ear.

While the remaining discussion will focus on the use of an electromagnetic input and an electromagnetic output transducer assembly, it should be appreciated that the present invention is not limited to such transmitter assemblies, and various other types of transmitter assemblies may be used with the present invention. For example, the photo-mechanical hearing transduction assembly described in co-pending and commonly owned, U.S. patent application Ser. No. 11/248,459, filed Oct. 11, 2005, entitled "Systems and Methods for Photo-mechanical Hearing Transduction," the complete disclosure of which is incorporated herein by reference, may be used with the hearing systems of the present invention. Furthermore, other transmitter assemblies, such as optical transmitters, ultrasound transmitters, infrared transmitters, acoustical transmitters, or fluid pressure transmitters, or the like may take advantage of the principles of the present invention.

BRIEF DESCRIPTION OF THE DRAWINGS

FIG. 3A illustrates a simplified, ear canal view of the known output transducer with a single activatable element of FIG. 2.

FIG. 3B is a side view of the output transducer of FIG. 2 in which a magnet is embedded in a support component.

FIG. 4A is an ear canal view of an embodiment of the output transducer that comprises a plurality of activatable elements that are in the form of magnetic particles.

FIG. 4B is a side view of FIG. 4A that illustrates random distribution of the magnetic particles that are embedded in the support component.

FIG. 4C is a zoom figure of a portion of FIG. 4B that illustrates the different sizes and random distribution of the magnetic particles and the alignment of the magnetic poles of each of the magnetic particles.

FIG. 5A is an ear canal view of an embodiment in which elongated magnetic elements are distributed within the support component.

FIG. 5B is a side view of FIG. 5A which illustrates that the elongated magnetic elements are oriented in a directed so that there is a force in a direction that is substantially orthogonal to an outer surface of the tympanic membrane.

FIG. 5C is a zoom of a portion of FIG. 5B that illustrates the alignment of the magnetic poles of each of the elongated magnetic elements.

FIG. 6A is an ear canal of an embodiment in which the activatable elements are distributed in quadrants of the tympanic membrane and the activatable elements are oriented along radial lines from a center of the tympanic membrane.

FIG. 6B is a side view of FIG. 6A which shows that the activatable elements are radially aligned and oriented such that actuation of the activatable elements creates a force in a direction orthogonal to the tympanic membrane.

DETAILED DESCRIPTION OF THE INVENTION

Figure 1:
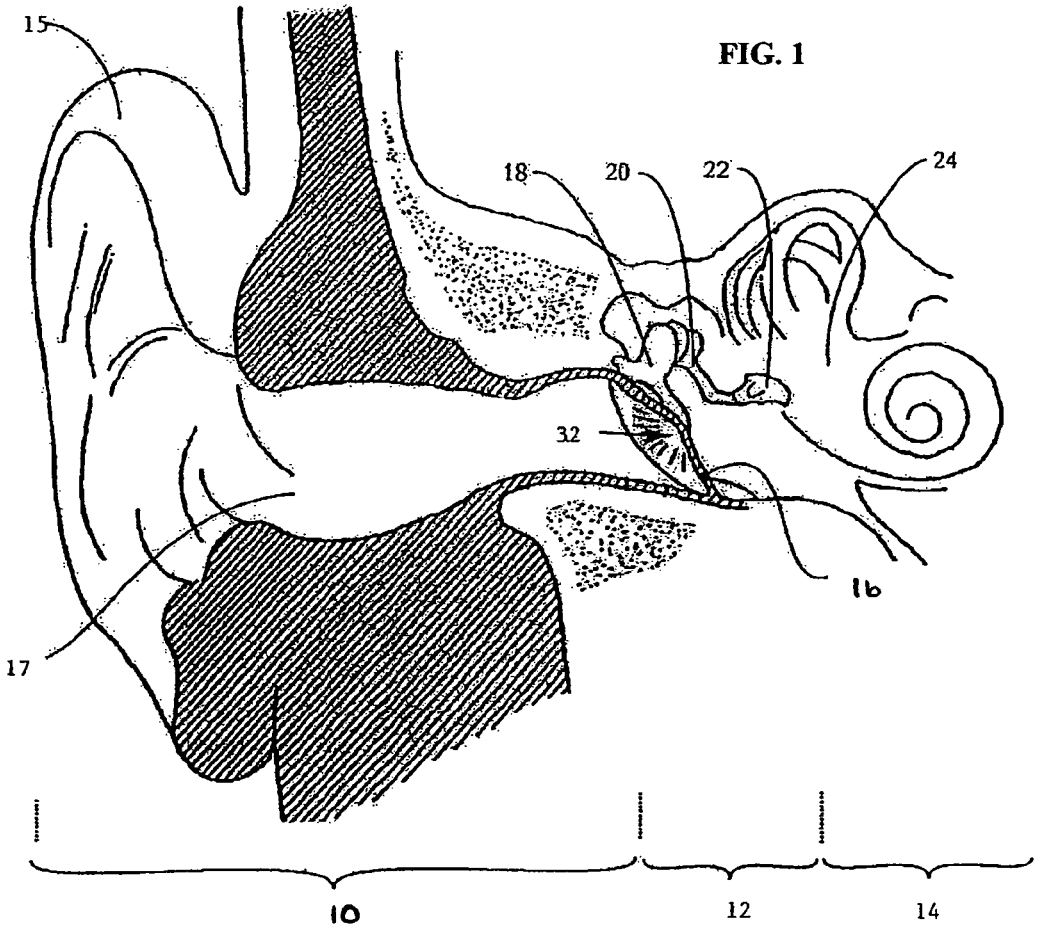
FIG. 1 is a cross-sectional view of a human ear, including an outer ear, middle ear, and part of an inner ear.

FIG. 1 shows a simplified cross sectional view of an outer ear 10, middle ear 12 and a portion of an inner ear 14. The outer ear 10 comprises a pinna 15 and an auditory ear canal 17. The middle ear 12 is bounded by the tympanic membrane (ear drum) 16 on one side, and contains a series of three tiny interconnected bones: the malleus (hammer) 18; the incus (anvil) 20; and the stapes (stirrup) 22. Collectively, these three bones are known as the ossicles or the ossicular chain. The malleus 18 is attached to the tympanic membrane 16 while the stapes 22, the last bone in the ossicular chain, is coupled to a spiral structure known as a cochlea 24 of the inner ear 14.

In normal hearing, sound waves that travel via the outer ear or auditory ear canal 17 strike the tympanic membrane 16 and cause it to vibrate. The malleus 18, being connected to the tympanic membrane 16, is thus also set into motion, along with the incus 20 and the stapes 22. These three bones in the ossicular chain act as a set of impedance matching levers of the tiny mechanical vibrations received by the tympanic membrane. The tympanic membrane 16 and the bones may act as a transmission line system to maximize the bandwidth of the hearing apparatus (Puria and Allen, 1998). The stapes 22 vibrates in turn causing fluid pressure in the vestibule of the cochlea 24 (Puria et al. 1997).

The fluid pressure results in a traveling wave along the longitudinal axis of the basilar membrane (not shown). The organ of Corti sits atop the basilar membrane which contains the sensory epithelium comprising of one row of inner hair cells and three rows of outer hair cells. The inner-hair cells (not shown) in the cochlea are stimulated by the movement of the basilar membrane. There, hydraulic pressure displaces the inner ear fluid and mechanical energy in the hair cells is transformed into electrical impulses, which are transmitted to neural pathways and the hearing center of the brain (temporal lobe), resulting in the perception of sound. The outer hair cells are believed to amplify and compress the input to the inner hair cells. When there is sensory-neural hearing loss, the outer hair cells are typically damaged, thus reducing the input to the inner hair cells which results in a reduction in the perception of sound. Amplification by a hearing system may fully or partially restore the otherwise normal amplification and compression provided by the outer hair cells.

Figure 2:
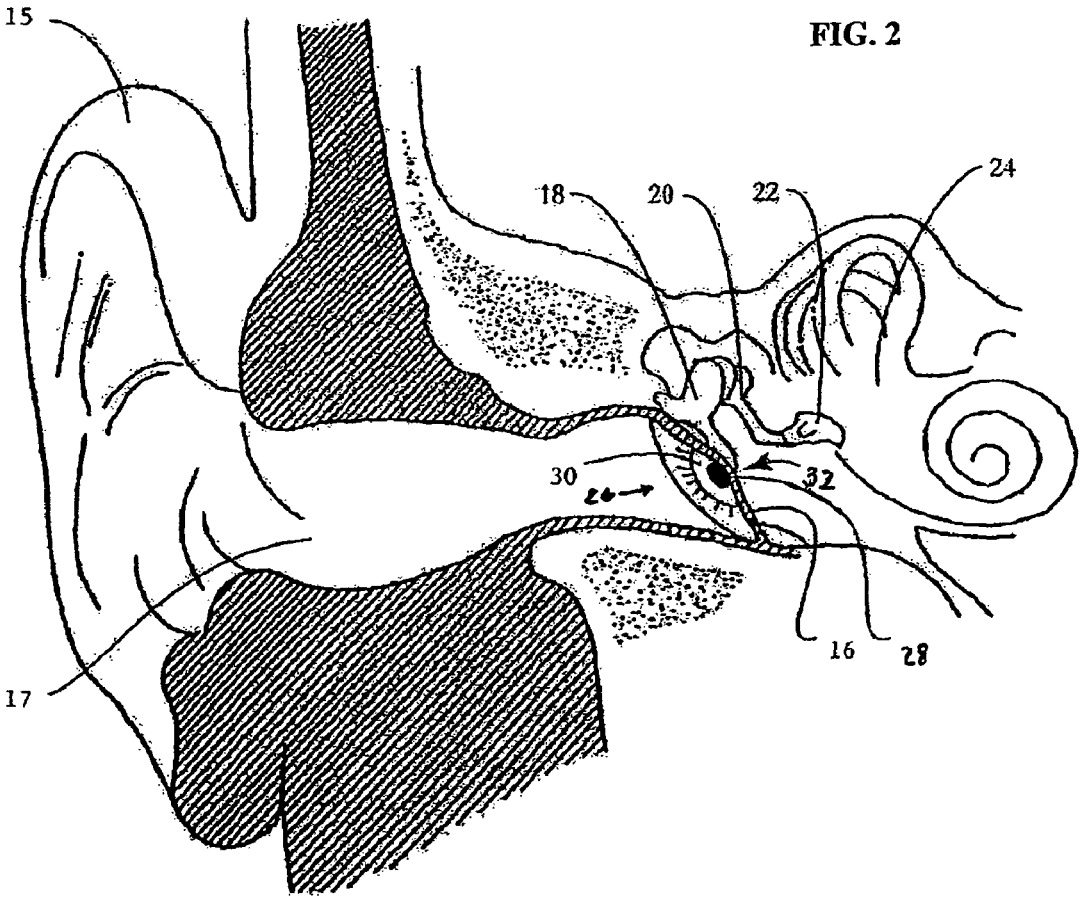
FIG. 2 illustrates an embodiment of a known output transducer coupled to a tympanic membrane.

As shown in FIG. 2, one presently preferred coupling point of an output transducer assembly 26 of the present invention is on an outer surface of the tympanic membrane 16. FIGS. 3A and 3B illustrate the output transducer assembly 26 of FIG. 2 in more detail. In the illustrated embodiment, the output transducer assembly 26 comprises an output transducer assembly 26 that is placed in contact with an exterior surface of the tympanic membrane 16. The output transducer assembly 26 generally comprises a single high-energy permanent magnet 28. A preferred method of positioning the output transducer assembly 26 is to employ a contact transducer assembly that includes magnet 28 and a support component 30. Support component 30 is attached to, or floating on, a portion of the tympanic membrane 16. The support component is vibrationally coupled to the tympanic membrane 16 and is typically comprised of a biocompatible material and has a surface area sufficient to support the magnet 28. The peripheral edge of the tympanic membrane is attached to bone at the tympanic annulus 15. The malleus 18 is partially visible through the semi-transparent tympanic membrane 16. The inferior portion of the malleus, shown in FIG. 3A by the dashed line, is also visible through the support element.

Preferably, the surface of support component 30 that is attached to the tympanic membrane substantially conforms to the shape of the corresponding surface of the tympanic membrane 16, particularly the umbo area 32. In one embodiment, the support component 30 is a conically shaped film that partially or fully encapsulates magnet 28 therein. In one configuration, support component comprises a transparent silastic support. In such embodiments, the film is releasably contacted with a surface of the tympanic membrane 16. Alternatively, a surface wetting agent, such as mineral oil (not shown), may be used to enhance the ability of support component 30 to form a weak but sufficient attachment to the tympanic membrane 16 through surface adhesion. A more detailed discussion of a contact output transducer assembly is described in U.S. Pat. No. 5,259,032, the complete disclosure of which is incorporated herein by reference.

Applicants have performed modeling work on eardrum mechanics and have hypothesized and shown that the reason why the motion at the umbo 32 of the tympanic membrane 16, and consequently the input to the cochlea, is smoothly varying is that the tympanic membrane 16 is deliberately mistuned (See Fay 2001; Fay et al. 2002). Thus, the design of the output transducer assembly 26 of the present invention lends itself to having the resonances localized to a particular quadrant or portion of the tympanic membrane 16 for a given input stimulus frequency. High amplitude motions at an outer edge of the tympanic membrane are indicative of resonance. For example, tones in the lower octaves of the audible frequency range may have preferred resonance on the posterior quadrant of the tympanic membrane, while the tones in upper octave range may have preferred resonance on the inferior quadrant, and mid frequency tones may have resonance in the anterior quadrant. These results suggest actuation of the eardrum in a likewise manner. The output transducer assemblies and hearing systems of the present invention may be used to provide selective drive actuation of different portions of the tympanic membrane.

FIGS. 4A to 6D illustrate various examples of output transducer assemblies 26 that provides improved vibrations of the middle ear, particularly at frequencies in the 2 to 15 kHz range. In the illustrated embodiments, instead of placing a single, high-energy permanent magnet 28 at a center of the support component 30, activatable material 34 (e.g., magnetic material) is distributed on a portion or all of the substrate that makes up support component 30. The distribution of the activatable material 34 may be distributed uniformly or non-uniformly on one or more surfaces of or embedded within the support component 30. Thus, certain parts of the ear lens can have a higher density of activatable material 34 than other parts. In addition, the activatable material 34 can be mixed directly into the substrate and then cured into the shape of the output transducer assembly 26 or the activatable material 34 could be attached later as a coating or printing on one or more surfaces of the support component 30.

In embodiments where the activatable material is a magnetic material, some care must be taken to mix in the correct amount of magnetic material for a given particle size. If too much material is mixed into the substrate that forms the support component 30, the entire structure will collapse on itself when the magnetic material is poled. In addition, as magnetic material is added to the substrate, it becomes much heavier, which adds to the insertion loss of the hearing system, which is acceptable if the effective force increases proportionately.

The distributed magnetic material over the support component has a number of advantages of a single, lumped permanent magnet. First, the magnetic force generated by the distributed magnetic particles will induce pressure over the entire surface of the tympanic membrane 16, so as to be similar to acoustic pressure generated by the actual sound waves. Second, the distribution pattern of magnetic material over the surface of the tympanic membrane 16 may be changed or personalized to the individual subject so as to "tune" the response for each quadrant of the tympanic membrane.

FIGS. 4A-4C illustrate one embodiment of a distributed output transducer assembly 26 of the present invention in which the activatable elements 34 are distributed and embedded within the support component 30. In the illustrated embodiment, the activatable material is in the form of magnetic elements or particles. While FIG. 4C illustrates that the magnetic elements are different sizes, the magnetic elements may be the same size or different sizes. Several different magnetic element sizes are envisioned for manufacturing the distributed magnet output transducer. For example, some preferred materials include, but is not limited to, a cobalt compound with samarium $Sa_2CO_7$ (http://www.sigma-aldrich-.com, product no. 339229) that have an estimated particle size that varies from about 20 μm to about 200 μm. Of course, if desired the magnetic elements may be smaller or larger As shown in FIG. 4C, the magnetic elements 34 are spaced from each other so as to reduce and preferably prevent the magnetic interaction with each other. Moreover, the magnetic elements 34 may have a random distribution on or in the support component 30 over the tympanic membrane. However, even with such a random distribution, as shown by the "N" and "S" orientation in each of the magnetic elements 34, it is desirable to have a magnetic orientation of each magnet be aligned in the same direction as the other magnetic particles. While FIG. 4C shows the "S" pole being directed toward the tympanic membrane 16, it should be appreciated that any orientation of the magnetic elements may be possible, as long as each of the magnetic elements 34 are substantially aligned with each other.

If the magnetic poles of the magnetic particles aren't substantially aligned in the same direction as each other, there may not be a net magnetic force in the far field. The alignment of the poles of the magnetic particles 34 is typically achieved during a magnetization period during manufacturing. Initially the ferromagnetic domains are not magnetized. In ferromagnetic materials, application of a magnetic field causes the ferromagnetic elements to be temporarily magnetized. If the field strength is sufficiently high, the ferromagnetic substance becomes a permanent magnet. When a magnetic field is applied to a magnet or a plurality of magnets—such as the present invention, each of the magnets experience a magnetic moment due to the dipole nature of the magnets. The moment is such that it exerts a force on all of the dipoles, which results in an alignment of the magnetic elements with the applied magnetic field. If the compliance of the support component 30 is such that the magnetic moment overcomes the local restoring force of the support component 30, the magnetic elements will tend to be substantially aligned with the uniform magnetic field. Once aligned, local mechanical forces due to, for example gravity and electrostatic charges, may tend to restore the particles back into a somewhat random orientation in the compliant substrate. However, to minimize this, the substrate that forms the support component can be cured rapidly to decrease the compliance and thus preserve the poled orientation of the embedded magnetic elements 34. It is contemplated that an external static magnetic field can be applied in the poled direction such the magnetized domains stay aligned during the curing process of the substrate.

FIGS. 5A-5C illustrate another embodiment of an output transducer assembly 26 that is encompassed by the present invention. As shown, the activatable elements 34 are in the form of elongated magnetic elements. Similar to FIGS. 4A-4C, the poles of the magnetic elements are substantially aligned with each other. The elongated magnetic elements provide a reduced magnetic moment in the plane of the tympanic membrane than the particle magnets of FIG. 4. Thus the elongated magnetic elements 34 of FIG. 5B are substantially aligned and oriented such that there is a force (upon activation) in a direction that is substantially orthogonal to the tympanic membrane. FIG. 5C illustrates the elongated magnetic elements in more detail. While FIG. 5C shows each of the elongated magnetic elements having a similar length and width, each of the elongated magnetic elements in the output transducer assembly 26 may have the same dimensions as each other or they may be different.

In one particular configuration, the elongated magnetic elements have dimensions less than or equal to 0.6 mm×0.2 mm×0.13 mm (W×L×H). Such elongated magnetic elements are sold by Seiko Corp. (See http://www.siimp.cojp/product/detail_e101.html). Of course, other embodiments of the present invention may have dimensions that are smaller or larger than the described embodiments. Larger magnetic elements require greater inter-magnet distances while smaller magnets result in greater packing density of the magnets.

FIGS. 6A and 6B illustrate a configuration in which all of the activatable elements 34 (e.g., elongated or non-elongated magnets) are aligned radially from a peripheral edge of the tympanic membrane 16 to a center of the tympanic membrane 16. In the embodiment illustrated in FIG. 6A, the magnetic elements 34 of one type may be configured to be in a wedge shape pattern so as to be specifically tuned to a quadrant of the eardrum. As shown by FIG. 6B, similar to FIG. 5B, the magnetic elements 34 are substantially aligned and oriented such that there is a force (upon activation) in a direction that is substantially orthogonal to the tympanic membrane 16.

If desired, slightly different dimensions or types of magnetic elements may be used for other quadrants and/or different material stiffness for the support component 30 may be used to appropriately tune the other quadrants of the tympanic membrane. The resonant frequency of a structure is proportional to the square root of the stiffness-to-mass-ratio. By controlling these parameters, the posterior quadrant can be designed to preferentially respond to low frequencies while the anterior quadrant can be designed to respond better at high frequencies. The stiffness of the support structure is controlled depositing elastic material with the desired elastic modulus in the different quadrants, while the mass is controlled by the size and number of magnetic elements.

Figure 6C:
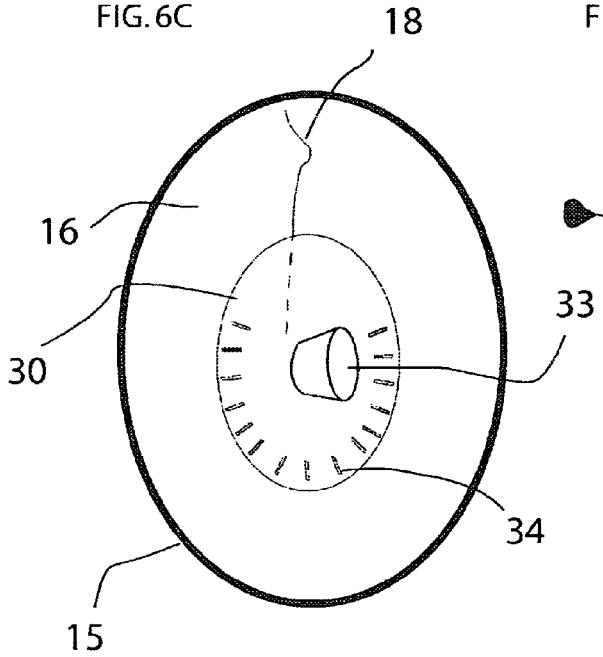
FIG. 6C is an ear canal view of an embodiment in which a central magnet 33 is combined with discrete magnets 34 within the support component 30.
Figure 6D:
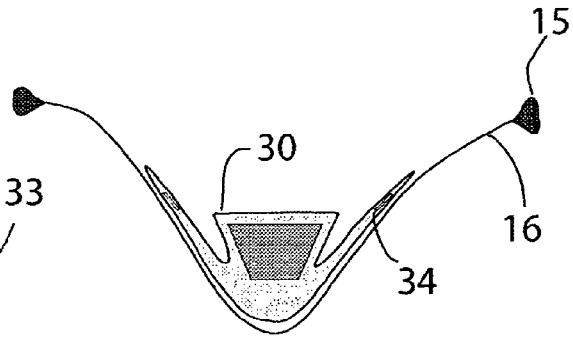
FIG. 6D is a side view of FIG. 6C which shows that both the central magnet and the peripheral magnets actuate the tympanic membrane to create a force in a direction orthogonal to the tympanic membrane surface.

While FIGS. 4A to 6D illustrate the activatable elements 34 embedded within the support component, the present invention further encompasses embodiments in which the activatable elements are placed on one or more surfaces of the support component 30 or are embedded within another substrate that is then coupled to one or more surfaces of the support component 30. FIGS. 6C and 6D illustrate an example where the small distributed magnets of the present invention are combined with a larger central magnet on the support element. The central magnet serves to efficiently drive the tympanic membrane at low frequencies while the distributed magnets efficiently drive the tympanic membrane at the higher frequencies.

Figure 7A:
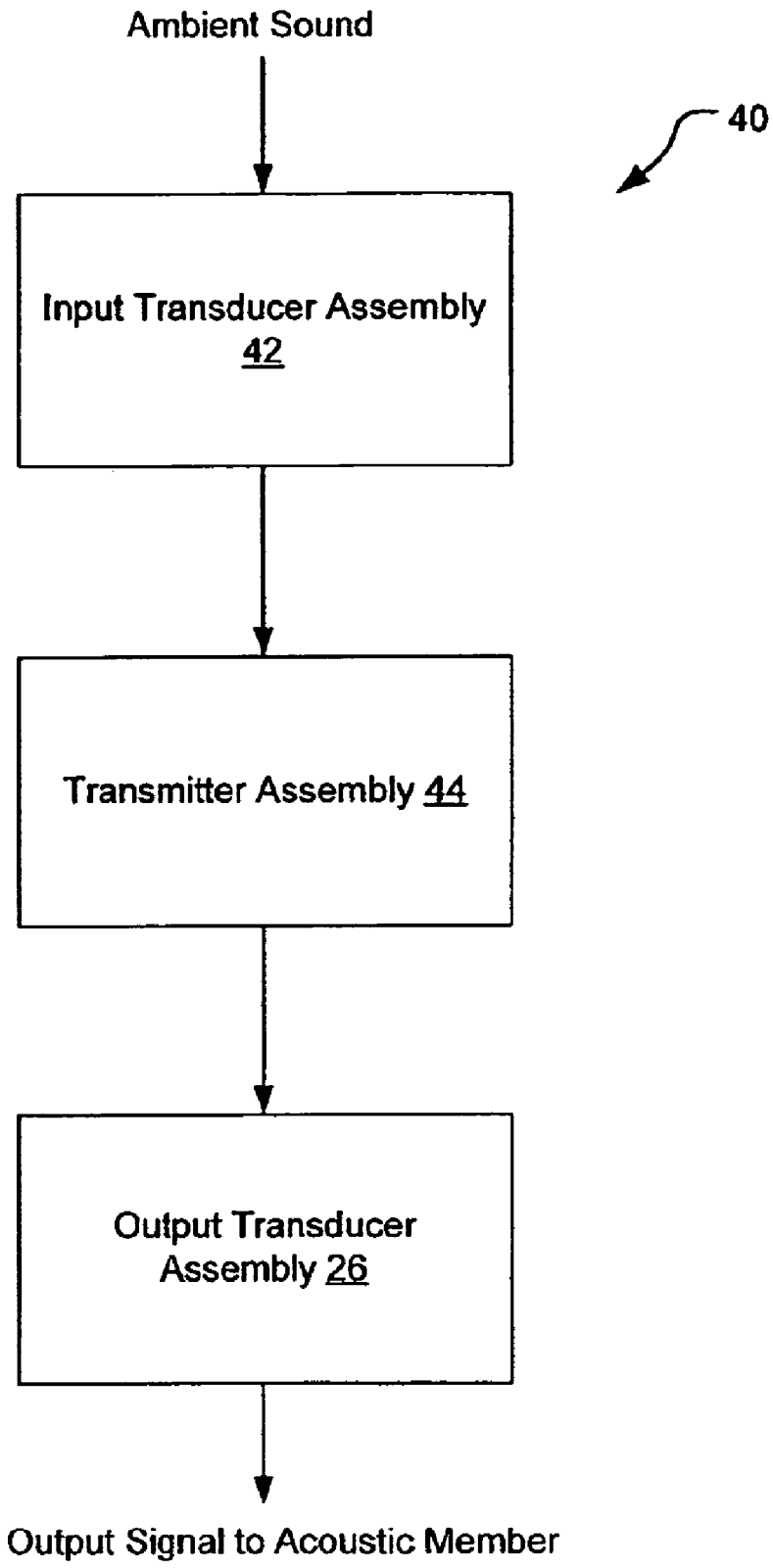
FIG. 7A illustrates a simplified hearing system of the present invention that includes in input transducer assembly, a transmitter assembly, and an output transducer assembly.

FIG. 7A illustrates a simplified hearing system 40 of the present invention. The hearing systems 40 constructed in accordance with the principles of the present invention generally comprise an input transducer assembly 42, a transmitter assembly 44, and any of the output transducer assemblies 26 described herein. The input transducer assembly 42 will receive a sound input, typically either ambient sound (in the case of hearing aids for hearing impaired individuals) or an electronic sound signal from a sound producing or receiving device, such as the telephone, a cellular telephone, a radio, a digital audio unit, or any one of a wide variety of other telecommunication and/or entertainment devices. The input transducer assembly 42 sends a signal to the transmitter assembly 44 where the transmitter assembly 44 processes the signal to produce a processed signal which is modulated in some way, to represent or encode a sound signal which substantially represents the sound input received by the input transducer assembly 42. The exact nature of the processed output signal will be selected to be used by the output transducer assembly 26 to provide both the power and the signal so that the output transducer assembly 26 can produce mechanical vibrations, acoustical output, pressure output, (or other output) which, when properly coupled to a subject's hearing transduction pathway, will induce neural impulses in the subject which will be interpreted by the subject as the original sound input, or at least something reasonably representative of the original sound input.

In the case of hearing aids, the input transducer assembly 42 typically comprises a microphone in a housing or shell that is disposed within the auditory ear canal 17. While it is possible to position the microphone behind the pinna, in the temple piece of eyeglasses, or elsewhere on the subject, it is preferable to position the microphone within the ear canal (as described in copending application "Hearing System having improved high frequency response", Ser. No. 11/121,517 filed to May 3, 2005, the full disclosure of which has been previously incorporated herein by reference). Suitable microphones are well known in the hearing aid industry and are amply described in the patent and technical literature. The microphones will typically produce an electrical output that is received by the transmitter assembly 44, which in turn will produce a processed digital signal. In the case of ear pieces and other hearing systems, the sound input to the input transducer assembly 42 will typically be electronic, such as from a telephone, cell phone, a portable entertainment unit, or the like. In such cases, the input transducer assembly 42 will typically have a suitable amplifier or other electronic interface which receives the electronic sound input and which produces a filtered electronic output suitable for driving the transmitter assembly 44 and output transducer assembly 26.

The transmitter assembly 44 of the present invention typically comprises a digital signal processor that processes the electrical signal from the input transducer and delivers a signal to a transmitter element that produces the processed output signal that actuates the output transducer assembly 26. In one embodiment, the transmitter element that is in communication with the digital signal processor is in the form of a coil that has an open interior and a core sized to fit within the open interior of the coil. A power source is coupled to the coil to supply a current to the coil. The current delivered to the coil will substantially correspond to the electrical signal processed by the digital signal processor. One useful electromagnetic-based assembly is described in commonly owned, copending U.S. patent application Ser. No. 10/902,660, filed Jul. 28, 2004, entitled "Improved Transducer for Electromagnetic Hearing Devices," the complete disclosure of which is incorporated herein by reference. As can be appreciated, the present invention is not limited to electromagnetic transmitter assemblies, and a variety of different transmitter assemblies may be used with the hearing systems of the present invention.

Figure 7B:
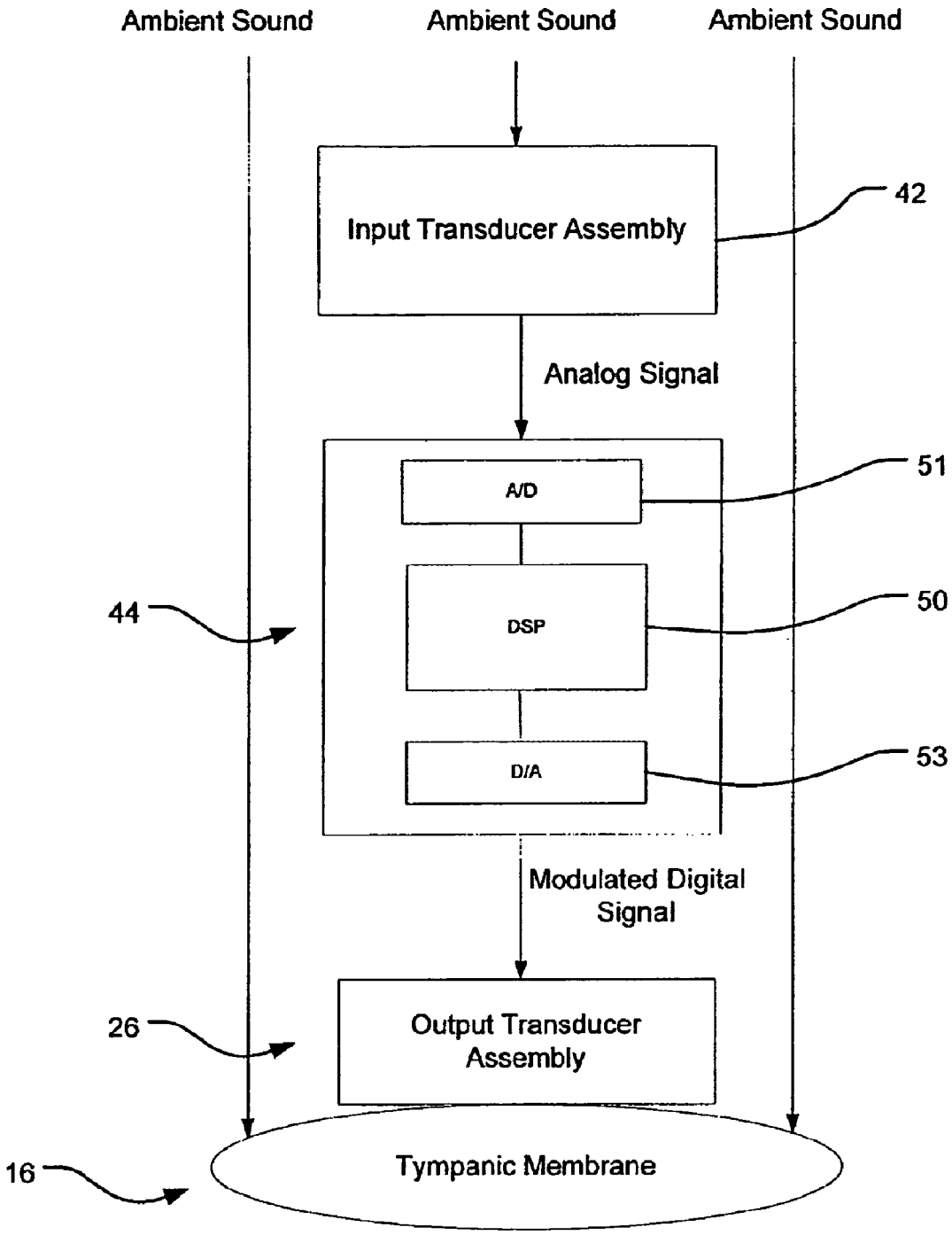
FIG. 7B is a more detailed illustration of a hearing system encompassed by the present invention.

FIG. 7B shows a more detailed hearing system 40 that embodies the present invention. In such embodiments, some of the ambient sound entering the auricle and ear canal 17 is captured by the input transducer assembly 42 (e.g., microphone) that is positioned within the open ear canal 17. The input transducer assembly 42 converts sound waves into analog electrical signals for processing by a digital signal processor (DSP) unit 50 of the transmitter assembly 44. The DSP unit 50 may optionally be coupled to an input amplifier (not shown) to amplify the electrical signal. The DSP unit 50 typically includes an analog-to-digital converter 51 that converts the analog electrical signal to a digital signal. The digital signal is then processed by any number of conventional or proprietary digital signal processors and filters 50. The processing may comprise of any combination of frequency filters, multi-band compression, noise suppression and noise reduction algorithms. The digitally processed signal is then converted back to analog signal with a digital-to-analog converter 53. The analog signal is shaped and amplified and sent to a transmitter element (such as a coil), which generates a modulated electromagnetic field containing audio information representative of the original audio signal and, directs the electromagnetic field toward the output transducer assembly 26 that comprises the distributed activatable elements (See FIGS. 3A-6B). The output transducer assembly 26 vibrates in response to the electromagnetic field, thereby vibrating the middle-ear acoustic member to which it is coupled (e.g. the tympanic membrane 16 in FIG. 2).

As noted above, the hearing system 40 of the present invention may incorporate a variety of different types of input/output transducer assemblies 42, 26 and transmitter assemblies 44. Thus, while the examples of FIGS. 8A to 9B illustrate electromagnetic signals, the hearing systems of the present invention also encompass assemblies which produce other types of signals, such as acoustic signals, pressure signals, optical signals, ultra-sonic signals, infrared signals, or the like.

The various elements of the hearing system 40 of the present invention may be positioned anywhere desired on or around the subject. In some configurations, all of the components of the hearing system 40 are partially disposed or fully disposed within the subject's auditory ear canal 17. For example, in one preferred configuration, the input transducer assembly 42 is positioned in the auditory ear canal so as to receive and retransmit the low frequency and high-frequency three dimensional spatial acoustic cues. If the input transducer assembly was not positioned within the auditory ear canal, (for example, if the input transducer assembly is placed behind-the ear (BTE)), then the signal reaching its input transducer assembly 42 may not carry the spatially dependent pinna cues, and there is little chance for there to be spatial information particularly in the vertical plane. In other configurations, however, it may be desirable to position at least some of the components behind the ear or elsewhere on or around the subject's body.

Figure 8A:
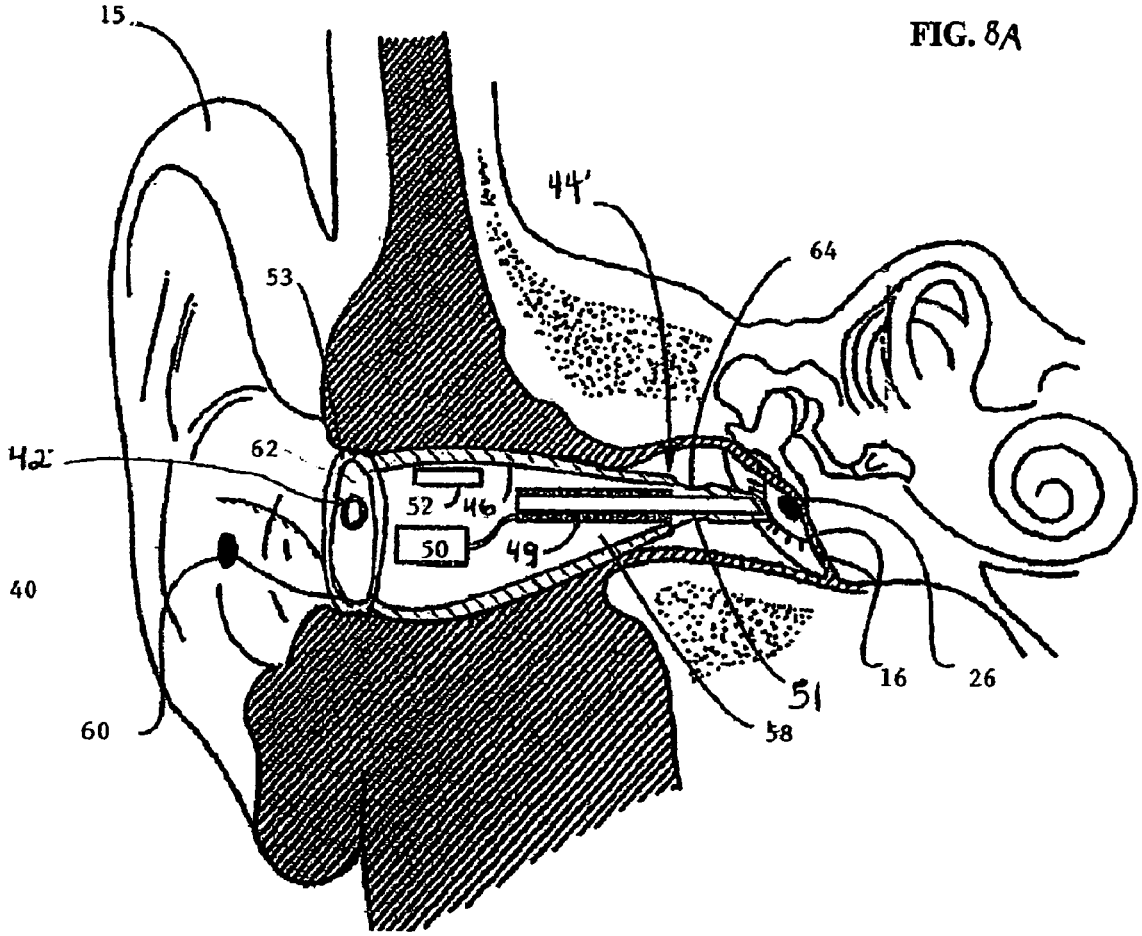
FIG. 8A schematically illustrates a hearing system of the present invention that provides an open ear canal so as to allow ambient sound/acoustic signals to directly reach the tympanic membrane.
Figure 8B:
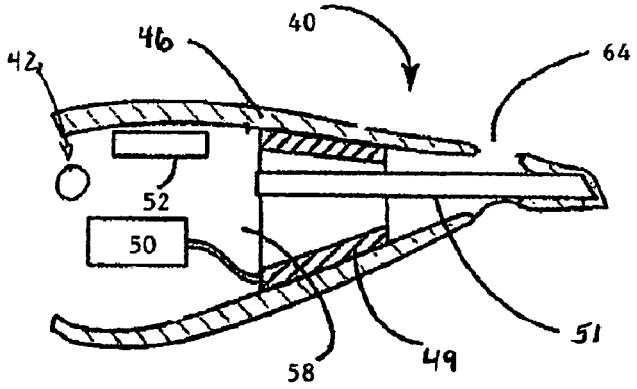
FIG. 8B illustrates an alternative embodiment of the hearing system of the present invention with a coil of a transmitter assembly laid along an inner wall of a shell.
Figure 9A:
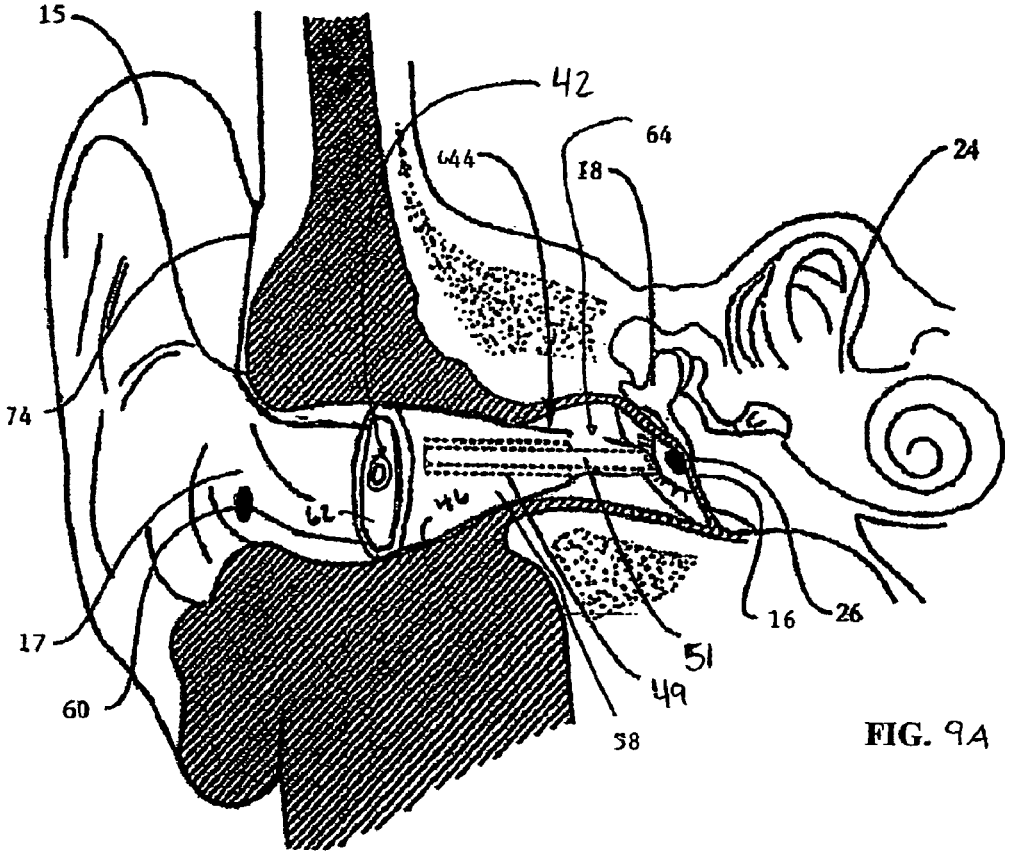
FIG. 9A illustrates a hearing system embodiment having a microphone (input transducer assembly) positioned on an inner surface of the shell and a transmitter assembly positioned in an ear canal that is in communication with the output transducer assembly that is coupled to the tympanic membrane.
Figure 9B:
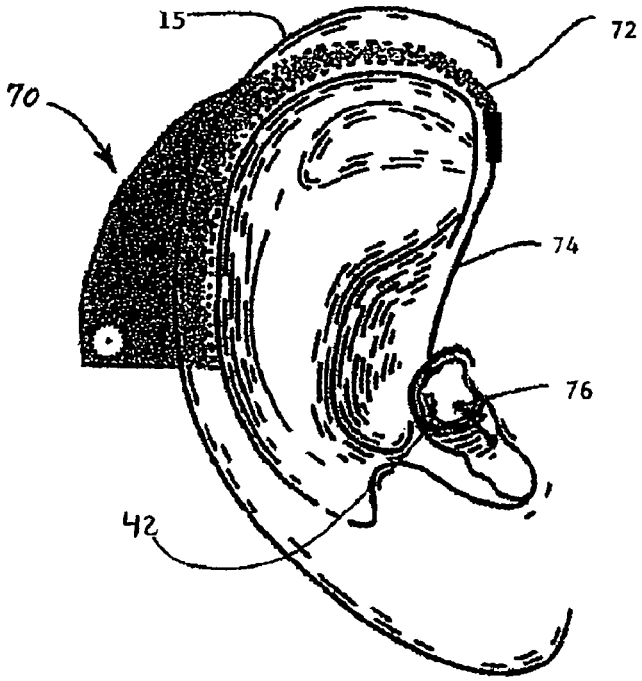
FIG. 9B illustrates an alternative medial view of the present invention with a microphone (input transducer assembly) in the shell wall near the entrance.

FIGS. 8A to 9B illustrate examples of hearing system 40 that are encompassed by the present invention. In the embodiment illustrated in FIGS. 8A and 8B, the components of the hearing system 40 of the present invention are disposed within a shell or housing 46 that is placed within the subject's auditory ear canal 17. Typically, the shell 46 has one or more openings 62, 64 on both a first end and a second end so as to provide an open ear canal and to allow ambient sound (such as low and high frequency three dimensional localization cues) to be directly delivered to the tympanic membrane. Advantageously, the openings 62, 64 in the shell 46 do not block the auditory canal 17 and minimize interference with the normal pressurization of the ear. In some embodiments, the shell 46 houses the input transducer assembly 42, the transmitter assembly 44, and a battery 52. In other embodiments, as shown in FIGS. 9A and 9B, portions of the transmitter assembly and the battery (shown as driver unit 70) may be placed behind the ear (BTE), while the input transducer assembly 42 is positioned in the shell 46 within the ear canal adjacent output transducer assembly 26.

FIG. 8A illustrates one preferred embodiment of a hearing system 40 encompassed by the present invention. The hearing system 40 comprises the transmitter assembly 42 (illustrated with shell 46 cross-sectioned for clarity) that is installed in a right ear canal and oriented with respect to the output transducer assembly 26 removably or permanently coupled to the tympanic membrane 16. In the preferred embodiment of the current invention, the output transducer assembly 26 is positioned against tympanic membrane 16 at umbo area. The output transducer assembly may also be removably or permanently placed on other acoustic members of the middle ear, including locations on the malleus 18, incus 20, and stapes 22. When placed in the umbo area 32 of the tympanic membrane 16, the output transducer assembly 26 will be naturally tilted with respect to the ear canal 17. The degree of tilt will vary from individual to individual, but is typically at about a 60-degree angle with respect to the ear canal.

Shell 46 is preferably matched to fit snug in the individual's ear canal so that the transmitter assembly 42 may repeatedly be inserted or removed from the ear canal and still be properly aligned when re-inserted in the individual's ear. In the illustrated embodiment, shell 46 is also configured to support a coil 49 and a core 51 of the transmitter assembly such that the tip of core 51 is positioned at a proper distance and orientation in relation to the output transducer assembly 26 when the transmitter assembly 44 is properly installed in the ear canal 17. This alignment requirement is relaxed with the present distributed and active elements. The core 51 generally comprises ferrite, but may be any material with high magnetic permeability.

In a preferred embodiment, coil 49 is wrapped around the circumference of the core 51 along part or all of the length of the core. Generally, the coil has a sufficient number of rotations to optimally drive an electromagnetic field toward the output transducer assembly 26. The number of rotations may vary depending on the diameter of the coil, the diameter of the core, the length of the core, and the overall acceptable diameter of the coil and core assembly based on the size of the individual's ear canal. Generally, the force applied by the magnetic field on the output transducer assembly 26 will increase, and therefore increase the efficiency of the system, with an increase in the diameter of the core. These parameters will be constrained, however, by the anatomical limitations of the individual's ear. The coil 49 may be wrapped around only a portion of the length of the core, as shown in FIG. 8A, allowing the tip of the core to extend further into the ear canal 17, which generally converges as it reaches the tympanic membrane 16.

One method for matching the shell 46 to the internal dimensions of the ear canal is to make an impression of the ear canal cavity, including the tympanic membrane. A positive investment is then made from the negative impression. The outer surface of the shell is then formed from the positive investment which replicated the external surface of the impression. The coil 49 and core 51 assembly can then be positioned and mounted in the shell 46 according to the desired orientation with respect to the projected placement of the output transducer assembly 26, which may be determined from the positive investment of the ear canal and tympanic membrane. In an alternative embodiment, the transmitter assembly 44 may also incorporate a mounting platform (not shown) with micro-adjustment capability for orienting the coil and core assembly such that the core can be oriented and positioned with respect to the shell and/or the coil. In another alternative embodiment, a CT, MRI or optical scan may be performed on the individual to generate a 3D model of the ear canal and the tympanic membrane. The digital 3D model representation may then be used to form the outside surface of the shell 46 and mount the core and coil.

As shown in the embodiment of FIG. 8A, transmitter assembly 44 typically comprise the digital signal processing (DSP) unit and other components 50 and a battery 52 that are placed inside shell 46. The proximal end 53 of the shell 46 may have opening(s) 62 and may have the input transducer assembly (microphone) 42 positioned on the shell 46 so as to directly receive the ambient sound that enters the auditory ear canal 17. An open chamber 58 provides access to the shell 46 and transmitter assembly 42 components contained therein. A pull line 60 may also be incorporated into the shell 46 so that the transmitter assembly can be readily removed from the ear canal.

Advantageously, in many embodiments, an acoustic opening 62 of the shell allows ambient sound to enter the open chamber 58 of the shell. This allows ambient sound to travel through the open volume 58 along the internal compartment of the transmitter assembly 42 and through one or more openings 64 at the distal end of the shell 46. Thus, ambient sound waves may reach and directly vibrate the tympanic membrane 16 and separately impart vibration on the tympanic membrane. This open-channel design provides a number of substantial benefits. First, the open channel 17 minimizes the occlusive effect prevalent in many acoustic hearing systems from blocking the ear canal. Second, the open channel allows the high frequency spatial localization cues to be directly transmitted to the tympanic membrane 17. Third, the natural ambient sound entering the ear canal 16 allows the electromagnetically driven effective sound level output to be limited or cut off at a much lower level than with a hearing system that blocks the ear canal 17. Finally, having a fully open shell preserves the natural pinna diffraction cues of the subject and thus little to no acclimatization, as described by Hoffman et al. (1998), is required.

FIG. 8B illustrates an alternative embodiment of a transmitter assembly 44 wherein the microphone 42 is positioned near the opening of the ear canal on shell 46 and the coil 49 is laid on the inner walls of the shell 46. The core 51 is positioned within the inner diameter of the coil 46 and may be attached to either the shell 46 or the coil 49. In this embodiment, ambient sound may still enter ear canal and pass through the open chamber 58 and out the ports or openings 64 to directly vibrate the tympanic membrane 16.

Now referring to FIGS. 9A and 9B, an alternative embodiment is illustrated wherein one or more of the DSP unit 50 and battery 52 are located external to the auditory ear canal in a driver unit 70. Driver unit 70 may hook on to the top end of the pinna 15 via ear hook 72. This configuration provides additional clearance for the open chamber 58 of shell 46 (FIG. 8B), and also allows for inclusion of components that would not otherwise fit in the ear canal of the individual. In such embodiments, it is still preferable to have the microphone 42 located in or at the opening of the ear canal 17 to gain benefit of high bandwidth spatial localization cues from the auricle 17. As shown in FIGS. 9A and 9B, sound entering the ear canal 17 is captured by input transducer assembly 42 (e.g., microphone). The signal is then sent to the DSP unit located in the driver unit 70 for processing via an input wire in cable 74 connected to jack 76 in shell 46. Once the signal is processed by the DSP unit, the signal is delivered to the coil 46 by an output wire passing back through cable 74. While FIGS. 8A to 9B illustrate hearing systems that provide an open ear canal, it should be appreciated, that the concepts of the present invention are equally beneficial to hearing systems that do not provide an open ear canal.

Figure 10:
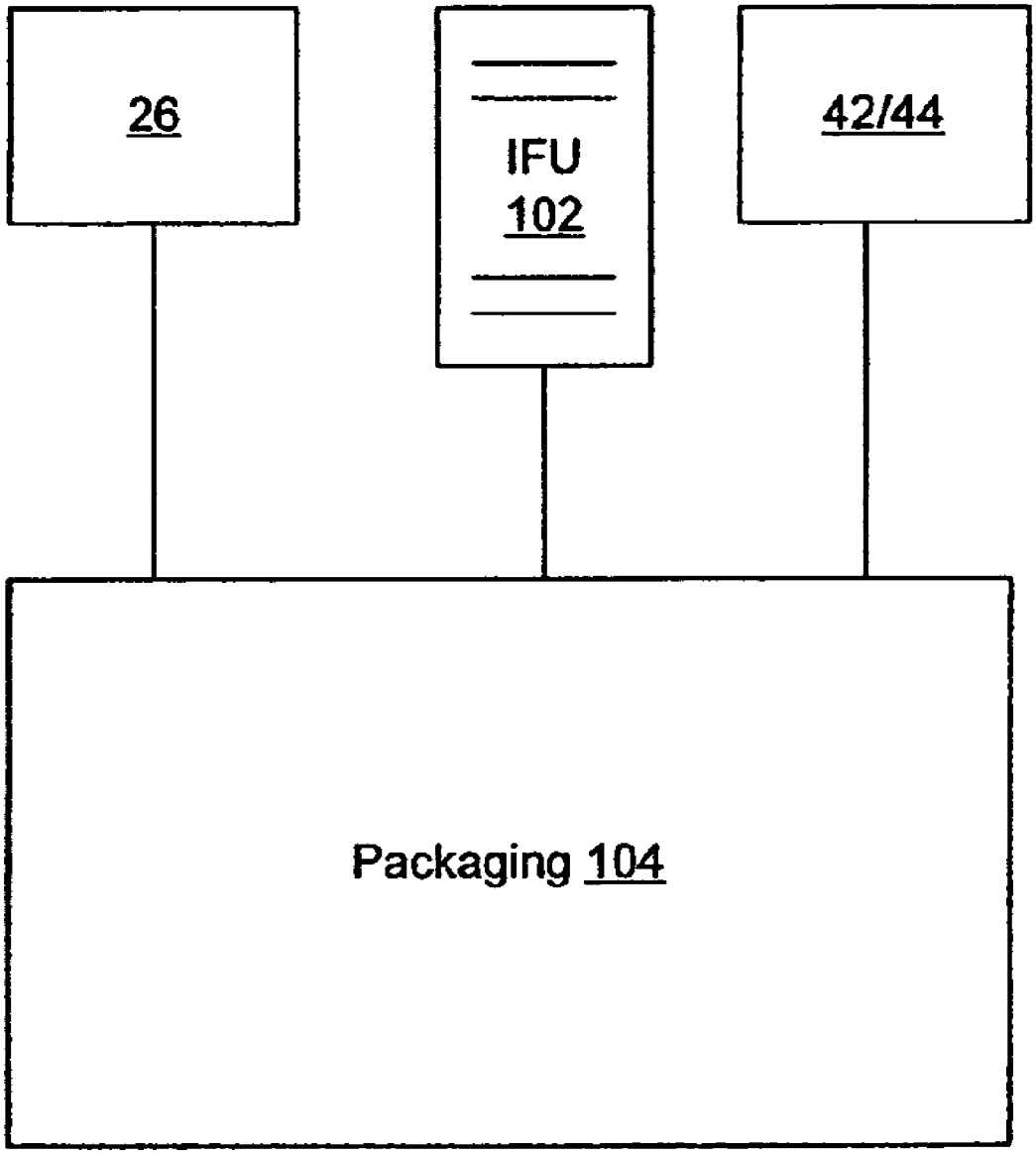
FIG. 10 illustrates a simplified kit encompassed by the present invention.

FIG. 10 illustrates a kit that is encompassed by the present invention. The kits 100 of the present invention include an output transducer assembly 26, instructions for use 102, and packages 104. Output transducer assembly 26 may be any of the output transducers shown and described above, and the instruction for use (IFU) 102 will set forth any of the methods described herein. Package 104 may be any conventional medical device packaging, including pouches, trays, boxes, tubes, or the like. The instructions for use 202 will usually be printed on a separate piece of paper, but may also be printed in whole or in part on a portion of the packaging 104. Optionally, the kits 100 of the present invention may also comprise the input transducer assembly 42 and/or the transmitter assembly 44.

While the above is a complete description of the preferred embodiments of the present invention, various alternatives, modifications, and equivalents may be used. For example, while the above description focuses on the use of a plurality of permanent magnets that are distributed across the tympanic membrane, it should be appreciated that the concepts of the present invention are equally applicable to other types of hearing systems and other acoustic members in the subject's ear. For example, the systems and methods of the present invention may be used to vibrate or otherwise actuate the subject's ossicular chain, cochlea, malleus, or the like.

The notion of distributed and tuned actuation on the eardrum can also be implemented with optical methods rather than the above electromagnetic methods. In this alternative embodiment, different quadrants of the eardrum are set in motion by an optically sensitive substrate which is actuated with optical signals. A more complete description of such systems and methods is described in U.S. patent application Ser. No. 11/248,459, filed Oct. 11, 2005 entitled "Systems and Methods of Photo-Mechanical Hearing Transduction," by Pluvinage, published on Aug. 24, 2006 as U.S. Publication No. 2006/0189841, the complete disclosure of which is incorporated herein by reference. Therefore, the above description should not be taken as limiting the scope of the invention which is defined by the appended claims.

What is claimed is:

1. An output transducer assembly for a hearing system for use with a human subject having a tympanic membrane, the tympanic membrane having a first portion responsive to first frequencies and a second portion responsive to second frequencies, the output transducer assembly comprising:

a support component that is configured to be coupled to the tympanic membrane of the human subject, the support comprising a first region configured to couple to the first portion of the tympanic membrane and a second region configured to couple to the second portion of the tympanic membrane; and a plurality of activatable elements distributed at a plurality of locations on the support component, wherein each of the plurality of activatable elements is responsive to light and wherein the activatable elements are configured to receive a light signal from an input transducer and provide a distributed vibration across the acoustic member in accordance with the light signal from the input transducer;

wherein the plurality of activatable elements is coupled to the first region and tuned in frequency to the first portion of the tympanic membrane and wherein the plurality of activatable elements is coupled to the second region and tuned in frequency to the second portion of the tympanic membrane, such that the first region vibrates preferentially in response to the first frequencies and the second region vibrates preferentially in response to the second frequencies.

2. The output transducer assembly of claim 1 comprising a surface wetting agent on a surface of the support component which contacts the tympanic membrane.

3. The output transducer assembly of claim 1 wherein the support component is configured to be permanently affixed to the tympanic membrane.

4. The output transducer assembly of claim 2 wherein the plurality of activatable elements are positioned over the support component to provide localized resonance to a particular portion of the tympanic membrane for a given input stimulus frequency.

5. The output transducer assembly of claim 1 wherein the first portion comprises a first quadrant of the eardrum and the second portion comprises a second quadrant of the eardrum and wherein a distribution of the plurality of activatable elements is configured to be tuned to the first quadrant of the tympanic membrane.

6. The output transducer assembly of claim 1 wherein the acoustic member is the subject's ossicular chain or cochlea.

7. The output transducer of claim 1 wherein the signal from the input transducer is a light signal and the plurality of activatable elements comprise a photosensitive material.

8. The output transducer assembly of claim 7 wherein the photosensitive material comprises a photostrictive material, a photochromic material, a silicon-based semiconductor material, or a chalcogenide glass.

9. The output transducer assembly of claim 1 wherein the signal from the input transducer is an electromagnetic signal and the plurality of activatable elements comprise a magnetic material.

10. The output transducer assembly of claim 9 wherein a magnetic orientation of the activatable elements are substantially aligned in a same direction as each other.

11. The output transducer assembly of claim 9 wherein the plurality of activatable elements comprise permanent magnets.

12. The output transducer assembly of claim 11 wherein the plurality of permanent magnets comprise cobalt.

13. The output transducer assembly of claim 11 wherein the plurality of permanent magnets comprise a particle size of no larger than about 200 microns.

14. The output transducer assembly of claim 11 wherein at least some of the plurality of permanent magnets are elongated.

15. The output transducer of claim 14 wherein a length along a longitudinal axis of the elongated permanent magnets about 600 microns or less.

16. The output transducer assembly of claim 14 wherein the acoustic member is a tympanic membrane, wherein the elongated permanent magnets are oriented so that actuation of the plurality of elongated permanent magnets create a force in a direction that is substantially orthogonal to an outer surface of the tympanic membrane.

17. The output transducer assembly of claim 16 wherein a longitudinal axis of the elongated permanent magnets are oriented substantially along radial lines of the tympanic membrane.

18. The output transducer assembly of claim 1 wherein the plurality of activatable elements are distributed non-uniformly over the support component.

19. The output transducer assembly of claim 1 wherein the plurality of activatable elements are distributed uniformly over the support component.

20. The output transducer assembly of claim 1 wherein the plurality of activatable elements are aligned radially from a peripheral edge of the support component to a center of the support component.

21. The output transducer assembly of claim 1 wherein the plurality of activatable elements are distributed within the support component.

22. The output transducer assembly of claim 1 wherein the plurality of activatable elements are distributed onto one or more surfaces of the support component.

23. The output transducer assembly of claim 1 wherein the plurality of activatable elements are distributed over the entire support component.

24. The output transducer assembly of claim 1 wherein a first portion of the support component comprises a higher density of activatable elements than a second portion of the support component.

25. The output transducer assembly of claim 1, wherein the first region is tuned to the first portion with a first stiffness to mass ratio and the second region is tuned to the second portion with a second stiffness to mass ratio.

26. A hearing system for use with a human subject having a tympanic membrane, the tympanic membrane having a first portion and a second portion, the system comprising:

an input transducer assembly which converts an ambient sound signal into an output signal; and an output transducer assembly comprising, a support component configured to be coupled to the tympanic membrane of the human subject, the support comprising a first region configured to couple to the first portion of the tympanic membrane and a second region configured to couple to the second portion of the tympanic membrane, and a plurality of activatable elements distributed over a plurality of locations on the support component, wherein the signal from the input transducer is a light signal and each of the plurality of activatable elements is responsive to light and wherein the activatable elements are configured to receive the output signal from the input transducer and vibrate in accordance with the output signal from the input transducer assembly, wherein the plurality of activatable elements is coupled to the first region and tuned in frequency to the first portion of the tympanic membrane and wherein the plurality of activatable elements is coupled to the second region and tuned in frequency to the second portion of the tympanic membrane, such that the first region vibrates preferentially in response to the first frequencies and the second region vibrates preferentially in response to the second frequencies.

27. The hearing system of claim 26 wherein the input transducer assembly comprises a microphone which receives ambient sound and generates the output signal.

28. The hearing system of claim 26 wherein the output transducer assembly comprises a surface wetting agent on a surface of the support component which contacts the tympanic membrane.

29. The hearing system of claim 28 wherein the plurality of activatable elements are positioned over the support component to provide localized resonance to a particular portion of the tympanic membrane for a given input stimulus frequency.

30. The hearing system of claim 26 wherein the first portion comprises a first quadrant of the eardrum and the second portion comprises a second quadrant of the eardrum and wherein a distribution of the plurality of activatable elements is configured to be tuned to the first quadrant of the tympanic membrane.

31. The hearing system of claim 26 wherein the output signal from the input transducer is a light signal and the plurality of activatable elements comprise a photosensitive material.

32. The hearing system of claim 31 wherein the photosensitive material comprises a photostrictive material, a photochromic material, a silicon-based semiconductor material, or a chalcogenide glass.

33. The hearing system of claim 26 wherein the plurality of activatable elements are distributed non-uniformly over the support component.

34. The hearing system of claim 26 wherein the plurality of activatable elements are distributed uniformly over the support component.

35. The hearing system of claim 26 wherein the plurality of activatable elements are aligned radially from a peripheral edge of the support component to a center of the support component.

36. The hearing system of claim 26 wherein the plurality of activatable elements are distributed within the support component.

37. The hearing system of claim 26 wherein the plurality of activatable elements are distributed onto one or more surfaces of the support component.

38. The hearing system of claim 26 wherein the plurality of activatable elements are distributed over the entire support component.

39. The hearing system of claim 26 wherein a first portion of the support component comprises a higher density of activatable elements than a second portion of the support component.

40. The hearing system of claim 26, wherein the first region is tuned to the first portion with a first stiffness to mass ratio and the second region is tuned to the second portion with a second stiffness to mass ratio.

41. A method for delivering sound to a human subject having a tympanic membrane, the tympanic membrane having a first portion responsive to first frequencies and a second portion responsive to second frequencies, the method comprising:

positioning an output transducer in contact with the tympanic membrane of the subject, wherein the output transducer assembly comprises a support and a plurality of photosensitive elements, wherein the support comprises a first region coupled to the first portion of the tympanic membrane and a second region coupled to the second portion of the tympanic membrane; and generating a distributed force-induced pressure over the acoustic member in accordance with a sound signal that enters the subjects ear canal and wherein the first region vibrates the first portion preferentially in response to the first frequencies and the second region vibrates the second portion preferentially in response to the second frequencies.

42. The method of claim 41 wherein positioning comprises placing the output transducer on the tympanic membrane with a support component and a surface wetting agent along a surface of the support component, wherein the output transducer is held against the tympanic membrane by surface tension.

43. The method of claim 41 wherein positioning comprises permanently affixing the output transducer on the tympanic membrane.

44. The method of claim 41 wherein the output transducer comprises a plurality of electromagnetic elements.

45. The method of claim 44 wherein the plurality of electromagnetic elements comprise magnetic elements.

46. The method of claim 45 wherein the magnetic elements comprise permanent magnets.

47. The method of claim 46 wherein the plurality of permanent magnets comprise a particle size of no larger than about 200 microns.

48. The method of claim 46 wherein at least some of the plurality of permanent magnets are elongated.

49. The method of claim 48 wherein the acoustic member is a tympanic membrane, wherein the elongated permanent magnets are oriented so that actuation of the plurality of elongated permanent magnets create the distributed force-induced pressure in a direction that is substantially orthogonal to an outer surface of the tympanic membrane.

50. The method of claim 48 wherein a longitudinal axis of the elongated permanent magnets are oriented substantially along radial lines of the tympanic membrane.

51. The method of claim 44, wherein the first portion comprises a first quadrant of the eardrum and the second portion comprises a second quadrant of the eardrum and wherein a distribution of the plurality of activatable elements is configured to be tuned to the first quadrant of the tympanic membrane.

52. The method of claim 44 comprising aligning a magnetic orientation of the plurality of electromagnetic elements in substantially the same direction as each other.

53. The method of claim 41 wherein the distributed force-induced pressure is generated by a plurality of activatable elements that are distributed non-uniformly over the acoustic member.

54. The method of claim 41 wherein the distributed force-induced pressure is generated by a plurality of activatable elements that are distributed uniformly over the acoustic member.

55. The method of claim 41 wherein the distributed force-induced pressure is generated by a plurality of activatable elements that are distributed within a support component that contacts the acoustic member.

56. The method of claim 41 wherein the distributed force-induced pressure is generated by a plurality of activatable elements that are distributed onto one or more surfaces of a support component that contacts the acoustic member.

57. The method of claim 56 wherein the plurality of activatable elements are distributed over the entire support component.

58. The method of claim 56 wherein an external static magnetic field is applied in the poled direction such that the magnetized domain stays aligned during the curing process of the substrate.

59. The method of claim 49 wherein the photosensitive elements comprise a photostrictive material, a photochromic material, a silicon-based semiconductor material, or a chalcogenide glass.

60. The method of claim 41, wherein the first region is tuned to the first portion with a first stiffness to mass ratio and the second region is tuned to the second portion with a second stiffness to mass ratio.

* * * * *